US006739416B2

(12) United States Patent
Presley et al.

(10) Patent No.: US 6,739,416 B2
(45) Date of Patent: May 25, 2004

(54) ENHANCED OFFSET STABILIZATION FOR ECCENTRIC REAMERS

(75) Inventors: W. Gregory Presley, Spring, TX (US); Christopher S. Charles, Houston, TX (US); D. Jay Clinkscales, Spring, TX (US); Jeffrey B. Lund, The Woodlands, TX (US); Matthew J. Meiners, Spring, TX (US); Steven R. Radford, The Woodlands, TX (US); Robert A. Laing, Spring, TX (US); Matthew D. Mumma, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/099,867

(22) Filed: Mar. 13, 2002

(65) Prior Publication Data

US 2003/0173114 A1 Sep. 18, 2003

(51) Int. Cl.[7] ..... E21B 10/26
(52) U.S. Cl. ..... 175/385; 175/335; 175/399
(58) Field of Search ..... 175/385, 334, 175/335, 398, 399, 408

(56) References Cited

U.S. PATENT DOCUMENTS

| | | | | | |
|---|---|---|---|---|---|
| 1,322,540 | A | * | 11/1919 | Chapman | 175/334 |
| 3,163,243 | A | * | 12/1964 | Cleary | 175/389 |
| 3,851,719 | A | | 12/1974 | Thompson et al. | |
| 4,635,738 | A | | 1/1987 | Schillinger et al. | |
| 5,009,271 | A | * | 4/1991 | Maric et al. | 175/53 |
| 5,052,503 | A | * | 10/1991 | Lof | 175/258 |
| 5,099,931 | A | * | 3/1992 | Krueger et al. | 175/75 |
| 5,099,934 | A | * | 3/1992 | Barr | 175/393 |
| 5,109,935 | A | * | 5/1992 | Hawke | 175/434 |
| 5,213,168 | A | * | 5/1993 | Warren et al. | 175/61 |
| 5,497,842 | A | | 3/1996 | Pastusek et al. | |
| 5,678,644 | A | * | 10/1997 | Fielder | 175/391 |
| 5,765,653 | A | | 6/1998 | Doster et al. | |
| 5,957,223 | A | | 9/1999 | Doster et al. | |
| 5,992,548 | A | * | 11/1999 | Silva et al. | 175/391 |
| 6,116,356 | A | | 9/2000 | Doster et al. | |
| 6,386,302 | B1 | | 5/2002 | Beaton | |
| 6,394,200 | B1 | | 5/2002 | Watson et al. | |
| 6,397,958 | B1 | * | 6/2002 | Charles et al. | 175/391 |
| 6,439,326 | B1 | * | 8/2002 | Huang et al. | 175/334 |
| 2002/0125047 | A1 | * | 9/2002 | Beaton | 175/406 |

FOREIGN PATENT DOCUMENTS

| | | | | |
|---|---|---|---|---|
| GB | 2031481 A | * | 4/1980 | E21B/10/66 |

OTHER PUBLICATIONS

Search Report dated May 6, 2003.

* cited by examiner

*Primary Examiner*—David Bagnell
*Assistant Examiner*—Daniel P Stephenson
(74) *Attorney, Agent, or Firm*—TraskBritt

(57) ABSTRACT

Enhanced stabilization is provided for an eccentric reaming tool when a pilot borehole is undersized with respect to a following pilot stabilization pad (PSP). Alternatively, offset of a rotational axis of at least a portion of the assembly including the reaming tool is employed to accomplish stabilization of the reaming tool. In either case, a reamed diameter larger than a physical diameter of the reaming tool may be drilled. More specifically, an enlarged PSP relative to pilot bit diameter or PSP offset or even pilot bit offset is employed in order to engage a PSP with the wall of a pilot borehole of greater diameter than a physical diameter of the pilot bit. The PSP or pilot drill bit, or both, may be laterally offset, angularly offset, or a combination thereof in order to effect substantially continuous PSP contact with the pilot borehole wall.

38 Claims, 7 Drawing Sheets

ENHANCED OFFSET STABILIZATION FOR ECCENTRIC REAMERS

BACKGROUND OF THE INVENTION

1. Field of the Invention

The present invention relates generally to enlarging the diameter of a subterranean borehole and, more specifically, to enlarging the borehole below a portion thereof which remains at a lesser diameter. The method and apparatus of the present invention includes the enhanced capability to stabilize a reaming tool.

2. State of the Art

It is known to employ both eccentric and bi-center bits to enlarge a borehole below a tight or undersized portion thereof.

An eccentric bit includes an eccentrically, laterally extended or enlarged cutting portion which, when the bit is rotated about its axis, produces a borehole larger than the overall diameter of the eccentric bit. An example of an eccentric bit is disclosed in U.S. Pat. No. 4,635,738.

A bi-center bit assembly employs two longitudinally superimposed bit sections with laterally offset longitudinal axes. The first axis is the center of the pass-through diameter, that is, the diameter of the smallest borehole the bit will pass through. This axis may be referred to as the pass-through axis. The second axis is the axis of the hole cut as the bit is rotated. This axis may be referred to as the drilling axis. There is usually a first, lower and smaller diameter pilot section employed to commence the drilling and rotation of the bit centered about the drilling axis as the second, upper and larger diameter main bit section engages the formation to enlarge the borehole, the rotational axis of the bit assembly rapidly transitioning from the pass-through axis to the drilling axis when the full-diameter, enlarged borehole is drilled.

Rather than employing a one-piece drilling structure such as an eccentric bit or a bi-center bit to enlarge a borehole below a constricted or reduced-diameter segment, it is also known to employ an extended bottomhole assembly (extended bi-center assembly) with a pilot bit at the distal or leading end thereof and a reamer assembly some distance above. This arrangement permits the use of any bit type, be it a rock (tri-cone) bit or a drag bit, as the pilot bit. Further, the extended nature of the assembly permits greater flexibility when passing through tight spots in the borehole as well as an opportunity to effectively stabilize the pilot bit so that the pilot hole and the following reamer will take the path intended for the borehole. This aspect of an extended bottomhole assembly is particularly significant in directional drilling.

While all of the foregoing alternative approaches can be employed to enlarge a borehole below a reduced-diameter segment, the pilot bit with reamer assembly has proven to be highly effective. The assignee of the present invention has, to this end, designed as reaming structures so-called "reamer wings" in the very recent past, which reamer wings generally comprise a tubular body having a fishing neck with a threaded connection at the top thereof and a tong die surface at the bottom thereof, also with a threaded connection. As an aside, short-bodied tools frequently will not include fishing necks, including the short-bodied reamer wings designed by the assignee of the present invention. The upper midportion of the reamer wing includes one or more longitudinally extending blades projecting generally radially outwardly from the tubular body, the outer edges of the blades carrying superabrasive (also termed "superhard") cutting elements; commonly, such superabrasive cutting elements, or cutters, are frequently comprised of PDC (Polycrystalline Diamond Compact) cutters. The lower midportion of the reamer wing may include a stabilizing pad having an arcuate exterior surface sized the same as or slightly smaller than the radius of the pilot hole on the exterior of the tubular body and longitudinally below the blades. The stabilizer pad is characteristically placed on the opposite side of the body with respect to the reamer wing blades so that the reamer wing will ride on the stabilizer pad due to the resultant force vector generated by the cutting of the blade or blades as the enlarged borehole is cut.

Notwithstanding the success of the aforementioned reamer wing design, it was recognized that such devices constructed as described above might not effectively and efficiently address the problem or task of achieving a rapid transition from pass-through to full-hole or "drill" diameter which closely tracks the path of the pilot bit and which does not unduly load the blades or bottomhole assembly during the transition. Since a reamer wing may have to re-establish a full-diameter borehole multiple times during its drilling life in a single borehole, due to washouts and doglegs of the pilot hole, a rapid transitioning ability when reaming is restarted as well as a robust design which can accommodate multiple transitions without significant damage was recognized as a desirable characteristic and design modification. U.S. Pat. No. 5,497,842, assigned to the assignee of the present invention and the disclosure of which is incorporated herein by reference, discloses the use of so-called "secondary" blades on the reamer wing to speed the transition from pass-through to drill diameter with reduced vibration and borehole eccentricity.

While the improvement of the '842 patent has proven significant, it was recognized that further improvements in the overall stability of the bottomhole assembly, including transitioning from pass-through diameter to drill diameter, would be highly desirable. One problem the prior art reamer assembly designs have experienced is undue vibration and even so-called bit "whirl," despite the focused or directed force vector acting on the reaming assembly and the presence of the stabilization pad. These undesirable phenomena appear to be related to the configuration of the stabilization pad (illustrated in FIG. 5 of the '842 patent), which engages the borehole wall axially and circumferentially under the radially directed resultant force vector of the reamer wing as the assembly drills ahead in the pilot hole, due to the pad's abrupt radial projection from the reamer wing body. Furthermore, it was observed that the entire bottomhole reaming assembly as employed in the prior art for straight-hole drilling with a rotary table or top Be drive often experiences pipe "whip" due to lack of sufficient lateral or radial stabilization above the reamer wing. In addition, such reaming assemblies driven by downhole steerable motors for so-called directional or navigational drilling sometimes experience problems with stability under the lateral forces generated by the reamer wing so as to make it difficult to maintain the planned borehole trajectory.

U.S. Pat. No. 5,765,653, assigned to the assignee of the present invention and the disclosure of which is incorporated herein by reference, addresses the aforementioned problems by providing an axially as well as circumferentially tapered pilot stabilizer pad ("PSP") (see FIGS. 4, 6, 7 and 7A of the '653 patent) to the reaming apparatus.

U.S. Pat. No. 5,957,223, assigned to the assignee of the present invention and the disclosure of which is incorporate herein by reference, also addresses stability of reaming tools. Specifically, the resultant lateral force vector generated via the pilot bit cutting elements is substantially radially aligned with the much larger lateral force vector generated by the reamer bit section. These two aligned force vectors thus tend to press the bit in the same lateral direction (which moves relative to the borehole sidewall as the bit rotates) along its entire longitudinal extent so that a single circumferential area of the pilot bit section gage rides against the sidewall of the pilot borehole, resulting in a reduced tendency for the bit to cock or tilt with respect to the axis of the borehole.

Furthermore, U.S. Pat. No. 6,116,356 assigned to the assignee of the present invention and the disclosure of which is incorporated by reference herein, provides a pilot stabilization pad (PSP) with an axially and circumferentially tapered, arcuate lower entry surface of increasing diameter as it extends upwardly and away from the direction of bit rotation, in combination with a contiguous, circumferentially tapered, transition surface gradually extending to a greater diameter with respect to the centerline of the reaming tool body opposite the direction of tool rotation. In addition, PSP placement may occur at one or more locations both longitudinally and circumferentially above the reaming apparatus. The PSP stabilizes a reaming assembly by contacting the pilot borehole, thus counteracting forces encountered by the reamer wing during reaming. Circumferential placement of the PSP may be determined by the resultant lateral force vector generated by the blades of the reamer. Thus, optimally, the PSP maintains intimate, stable, and substantially continuous contact with the wall of the pilot borehole not only during entry of the PSP into the pilot hole but also thereafter during the hole opening process.

Unfortunately, one remaining problem with the use of state of the art reaming apparatus is that often the pilot hole is slightly oversized for any number of reasons. An "oversized pilot borehole" as herein used denotes that the pilot borehole diameter is somewhat larger than the diameter of the pilot bit or other tool used to create the pilot borehole. Usually, the diameter of the pilot borehole is intended to be substantially identical to the diameter of the tool used to create the pilot borehole. Thus, the stability advantages of the PSP are somewhat compromised when the pilot borehole is oversized, since the additional size of the pilot borehole provides less lateral constraint during rotation than a smaller pilot borehole would provide. In addition, since the PSP is typically rotationally located on a substantially opposing side of the reaming tool in relation to the blades of the reamer wing, the excessive diameter of the pilot borehole allows the reamer wing blades to be displaced inwardly from the desired diameter of the reamed borehole. Therefore, the reamer wing drills an undersized reamed borehole in response to the pilot borehole being oversized.

BRIEF SUMMARY OF THE INVENTION

The present invention includes apparatus and methods addressing recognized problems associated with reaming when an oversized pilot borehole occurs. More specifically, the present invention configures a reaming tool so that the PSP may provide stability in a pilot borehole which is oversized relative to the physical pilot bit diameter used to drill the pilot borehole so as to ream the desired borehole size or diameter. The PSP as well as the pilot bit may be modified in size or configuration or laterally offset, angularly offset, or both, to enable the PSP to provide enhanced stability for reaming the pilot borehole size or diameter to its intended magnitude. In one embodiment, an outer bearing surface of the PSP may be sized so that the rotational diameter traversed by the PSP may be at least the same as, or even greater than, the physical diameter of the pilot bit. In any case, in contrast to conventional reaming tools, the reaming tool of the present invention may be used to effect a reamed borehole diameter which is larger than a physical diameter of the reaming tool by taking advantage of, rather than seeking to avoid, a pilot bit drilling a pilot borehole which is oversized with respect to the pilot bit's physical diameter.

The present invention includes, without limitation, configuring a reaming tool to provide improved stabilization in a pilot borehole which is oversized with respect to the pilot bit physical diameter. Specifically, one or more of the pilot bit, bit sub, PSP, or other reaming tool element or component may be laterally offset from a conventional position in order to provide enhanced stability to the reaming tool. For instance, an undersized pilot bit may be laterally offset or configured to provide a borehole that may closely match the PSP diameter during reaming while drilling. Alternatively or additionally, the PSP may be laterally offset, sized or configured to closely correspond to the diameter of an oversized pilot borehole drilled by the pilot bit. As an example, the PSP may be offset with respect to the pilot borehole axis, thus enabling engagement of the offset PSP with the wall of the oversized borehole drilled by the pilot bit. As another example, the PSP may be sized with an outer bearing surface extending radially so that, when the reaming tool is rotated, the PSP sweeps a diameter the same as or greater than that of a coaxially rotating pilot bit.

Further, the pilot hole assembly attached to the reamer wing or other reamer portion of the reaming tool may be laterally or angularly offset from the reaming axis of the reamer wing. Doing so causes the pilot bit to drill an oversize pilot borehole, the size of the pilot borehole being determined by the amount of offset as well as the pilot bit diameter. The PSP may also have an offset bearing surface placed and circumferentially located to accommodate the offset of the pilot hole assembly for substantially continuously contacting the pilot borehole wall. In addition, a gage area of the pilot drill bit may be configured to substantially continuously contact the wall of the pilot borehole as well.

DETAILED DESCRIPTION OF THE EMBODIMENTS

Figure 1:
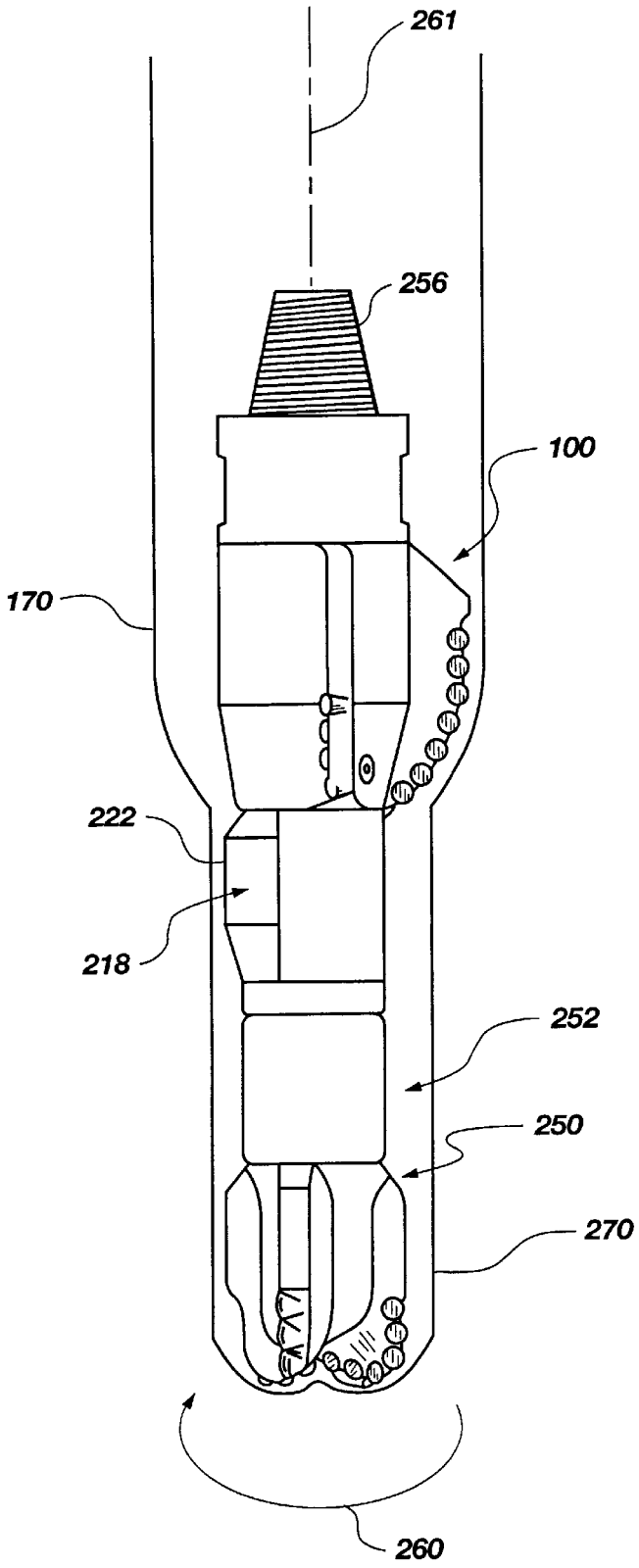
Fig. 1 (PRIOR ART)
FIG. 1 depicts a conventional reaming assembly disposed in a borehole.

FIG. 1 illustrates a conventional reaming assembly configuration with a pilot drill bit 250 attached to a short pilot sub 252. Reamer wing 100 is configured with a PSP 218 as well as comprising a tubular body and axial bore therethrough. Reamer wing 100, short pilot sub 252, and pilot drill bit 250 are secured in an assembly via API threaded connections 256 or other connections as known in the art. Reamer wing 100, short pilot sub 252, and pilot drill bit 250 are each designed to have a coincident centroidal rotational axis about each respective centroid of each cross-sectional area. Thus, centroidal rotational axes lie at the position about which, when rotated, the rotational diameter of each component is minimized. "Rotational diameter" may be defined as being the overall diameter encompassed by a body rotating about an axis without any applied forces. Therefore, a body rotated about any axis that is displaced from its centroidal rotational axis has a rotational diameter that is larger than the rotational diameter about its centroidal rotational axis.

Figure 4:
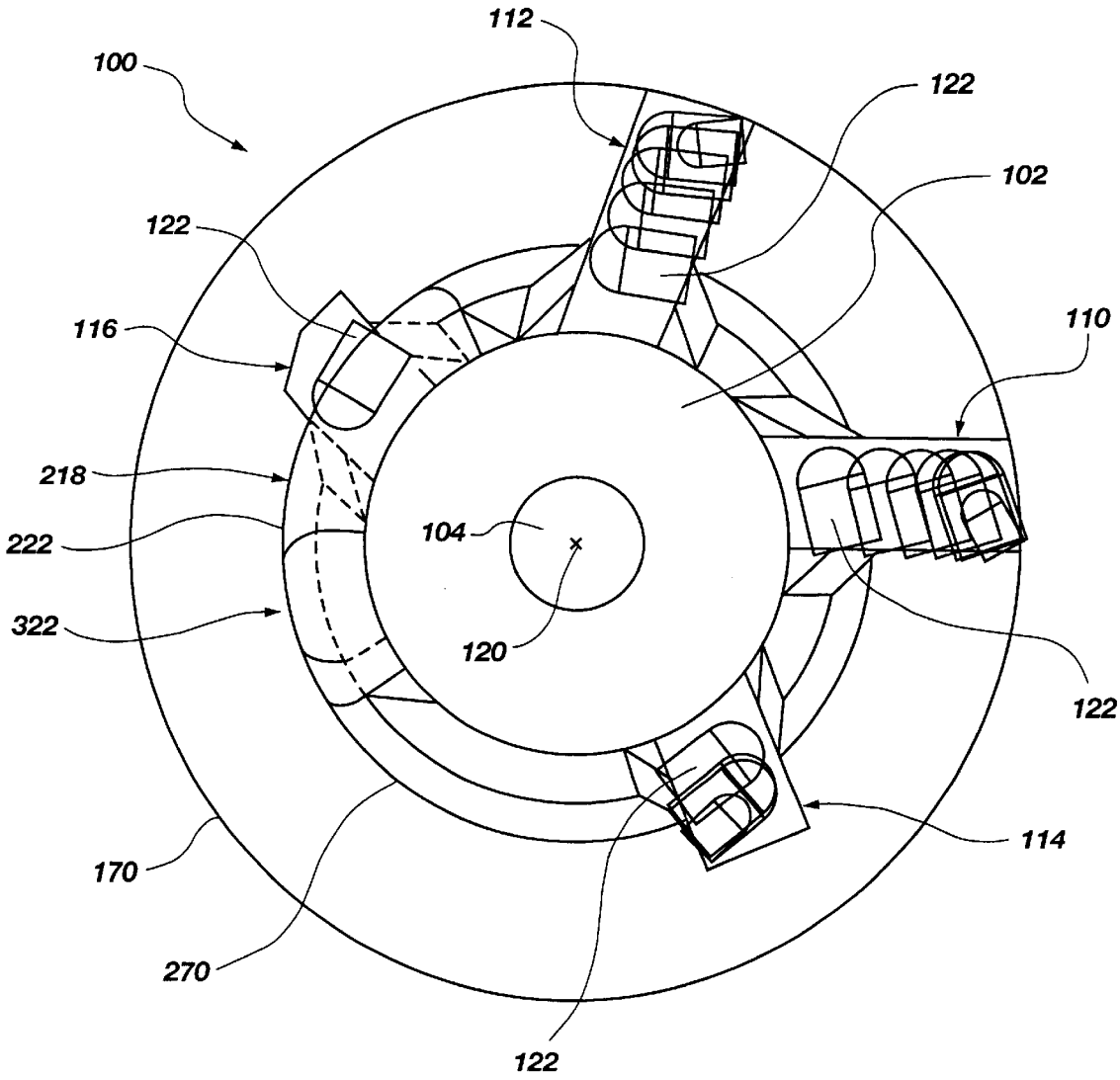
FIG. 4 depicts a cross-sectional view of a reaming assembly according to the present invention with a pilot stabilization pad and contact gage pad of a pilot drill bit substantially circumferentially aligned.

The reaming axis 261 of reamer wing 100 is depicted in FIG. 1 and in FIG. 4 as a longitudinal axis passing through the reamed borehole center point 120, perpendicular to the cross-sectional plane of the borehole as depicted by FIG. 4. The reaming axis 261 represents the rotational axis of the reamer wing 100 when the reamer wing 100 is reaming to cut its designed diameter. Rotational direction 260 is shown in FIG. 1. The reaming axis 261 direction (or angle) may change during the progress of the reamer wing 100 and pilot drill bit 250, due to forces applied during reaming, or during directional drilling as known in the art.

As used herein, "offset" denotes a centroidal rotational axis that is displaced from the reaming axis 261. In a conventional reaming assembly, the centroidal rotational axis of the pilot drill bit 250 generally coincides with the reaming axis 261. Further, the PSP 218 is located and configured so that its rotational diameter coincides with the pilot bit diameter, as shown in FIG. 1.

A reaming operation occurs as the pilot drill bit 250 rotates under applied longitudinal force, thus removing material from the formation below the pilot borehole 270. Simultaneously, the reamer wing 100 rotates about reaming axis 261 in the rotational direction 260, removing formation material remaining between the diameter of the pilot borehole 270 and the diameter of the reamed borehole 170. As formation material is removed by the pilot drill bit 250 and the reamer wing 100, the assembly advances longitudinally at a rate of penetration (ROP) commensurate with the applied forces, rotational speed, material formation characteristics, and other well-known parameters.

Figure 6:
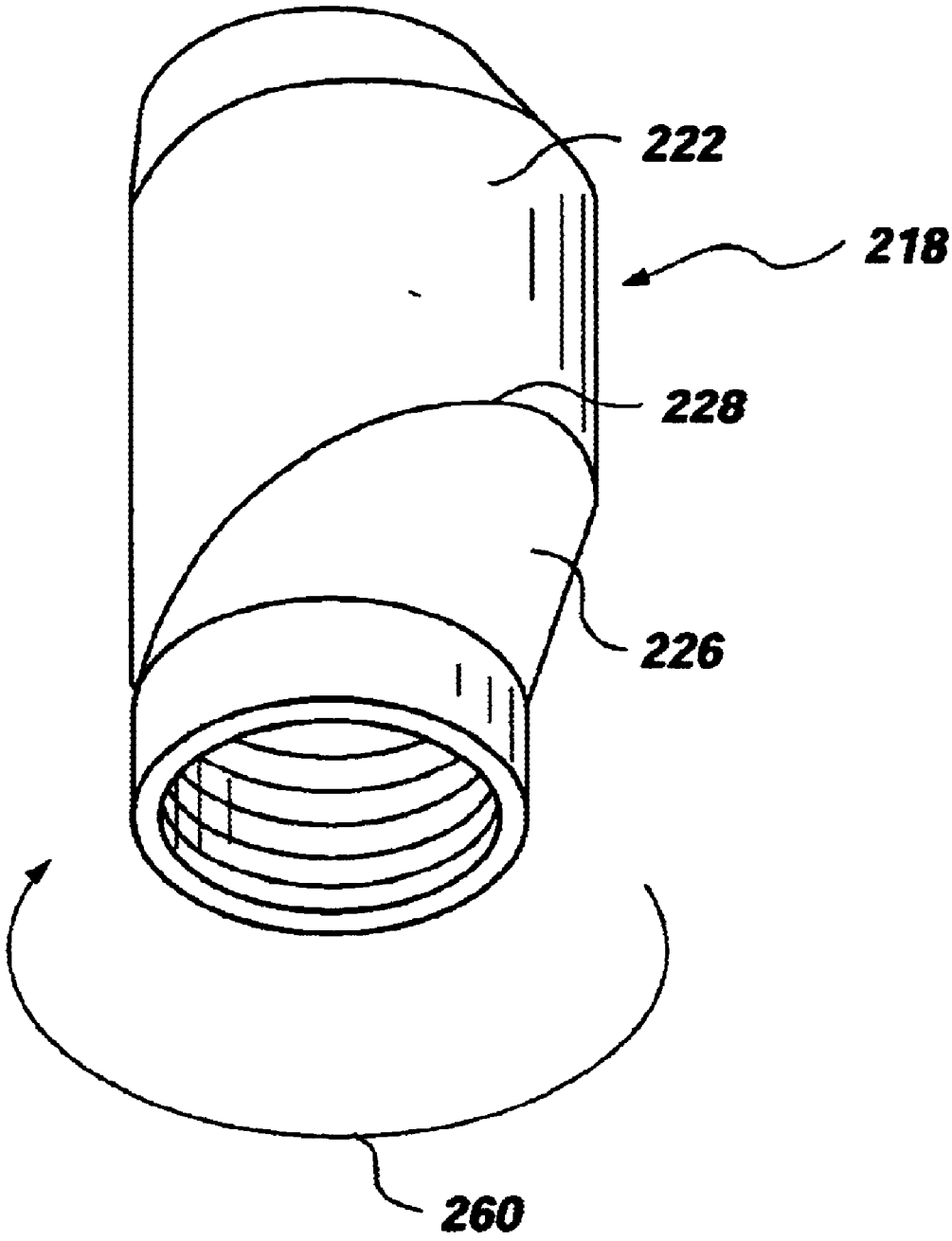
FIG. 6 is a perspective view of a pilot stabilization pad suitable for use in implementing the present invention.

PSP 218, shown in FIG. 6, comprises an entry surface 226 as well as a circumferential bearing surface 222, which may be faced with tungsten carbide bricks, hardfacing, and/or diamond wear surfaces, or other hardfacing means as known in the art. Boundary 228 separates entry surface 226 and bearing surface 222. PSP 218 may be formed separately from reamer wing 100 and comprise API threaded connections or other connections as known in the art at each end thereof, or be integral with reamer wing 100. Bearing surface 222 should continuously and intimately contact the surface of the pilot borehole wall to provide optimum reaming stabilization under operational conditions. However, as shown in FIG. 1 and exemplary of the prior art, the pilot drill bit 250 is drilling an oversized pilot borehole 270. Oversized pilot borehole 270 may be caused by dynamic drilling forces, nonuniform formation characteristics, or other causes. Thus, bearing surface 222 is not contacting the pilot borehole 270 continuously and, therefore, does not stabilize the reamer wing 100 as intended. As noted previously, the lack of continuous contact of bearing surface 222 of PSP 218 due to the oversized diameter of the pilot borehole 270 results in an undersized diameter for reamed borehole 170 as the blades of the reamer wing 100, cutting their reamed borehole diameter in a direction substantially radially opposite bearing surface 222, are permitted to move radially inwardly by a distance substantially equal to one-half of the dimension by which the pilot borehole 270 is oversized.

Figure 2:
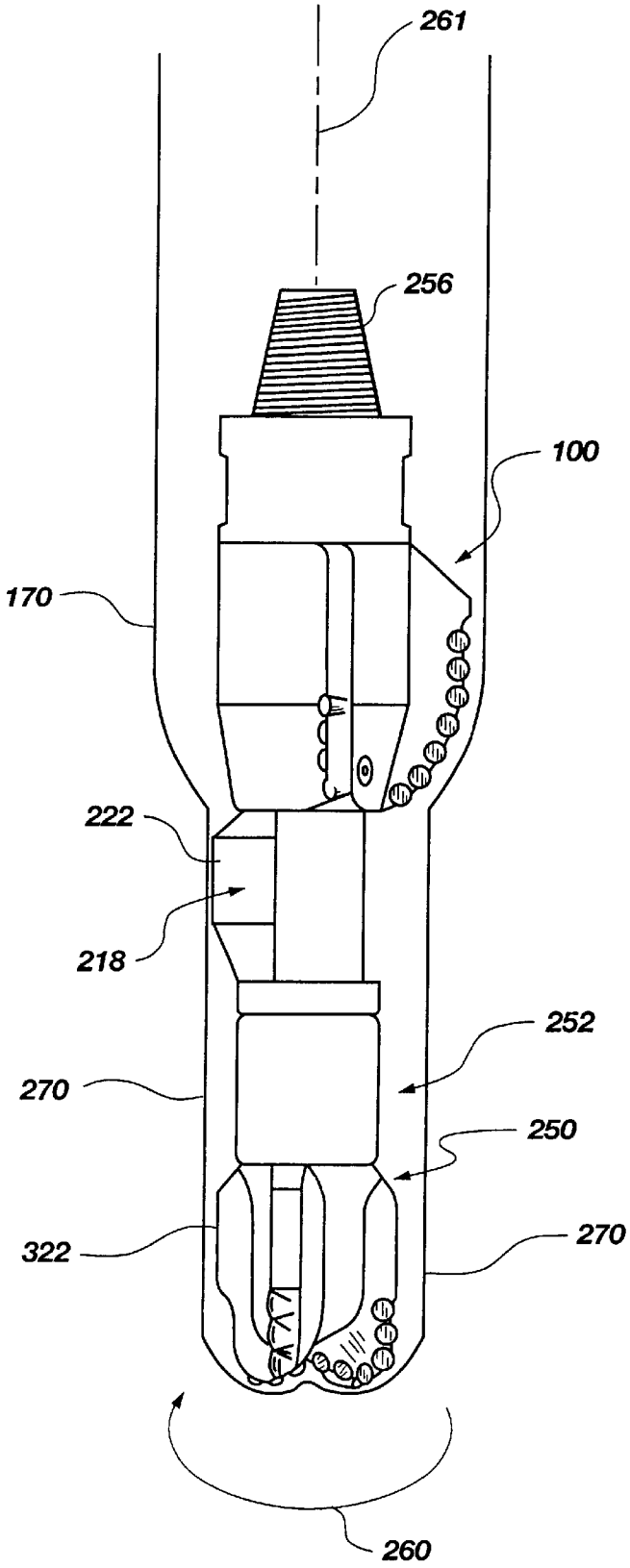
FIG. 2 depicts an embodiment of a reaming assembly according to the present invention disposed in a borehole.

FIG. 2 illustrates a side cross-sectional elevation of a PSP 218 configuration according to the present invention to accomplish PSP stabilization of reamer wing 100. Features and elements of PSP 218 configuration previously referenced with respect to FIG. 1 are designated by like or similar numerals in FIGS. 2–7. As shown, the PSP 218 centroidal rotational axis may be laterally offset from, but parallel to, the reaming axis 261 of the reamer wing 100 (and pilot borehole 270, as well as pilot drill bit 250) in order to effectively contact the wall of oversized pilot borehole 270. Stated another way, PSP 218 may be offset laterally or radially to provide a rotational diameter for bearing surface 222 greater than the physical diameter of pilot drill bit 250. The amount of required or desired offset for PSP 218 may be predicted or empirically determined, as desired. Alternatively and possibly more a more straightforward approach to implement from a manufacturing standpoint, PSP 218 may exhibit a centroidal rotational axis coincident with the reaming axis 261, which is also the axis of pilot drill bit 250. However, in this instance, the outermost diameter of bearing surface 222 of PSP 218 with respect to reaming axis 261 is sized so that the diameter swept by the PSP 218 upon rotation of reamer wing 100 is substantially the same as, or greater than, the physical diameter of pilot drill bit 250. Bearing surface 222 is thus positioned and configured for substantially continuously and conformally contacting the wall of pilot borehole 270 to provide stabilization as the reamer wing 100 progresses during drilling. In this embodiment, the pilot drill bit 250 drills essentially as shown in the prior art, and its centroidal rotational axis is aligned to the reaming axis 261. However, PSP 218 is offset or sized to effectively stabilize the reamer wing 100 during reaming, even if the pilot borehole is drilled to a size larger than the physical diameter of pilot drill bit 250.

In the embodiment shown in FIG. 2, the borehole is oversized due to extraneous forces, dynamic behavior, and/or pliability of the reaming apparatus. Therefore, the amount which the pilot borehole diameter is oversized may be known in advance, from prior experience, or from predictive computer modeling or otherwise predicted or known. The offset of PSP 218 is therefore placed at one-half or more of the distance by which the pilot borehole is predicted to be oversized to accommodate the increased pilot bit diameter and positively maintain the bearing surface 222 of PSP 218 against the wall of pilot borehole 270.

Figure 3:
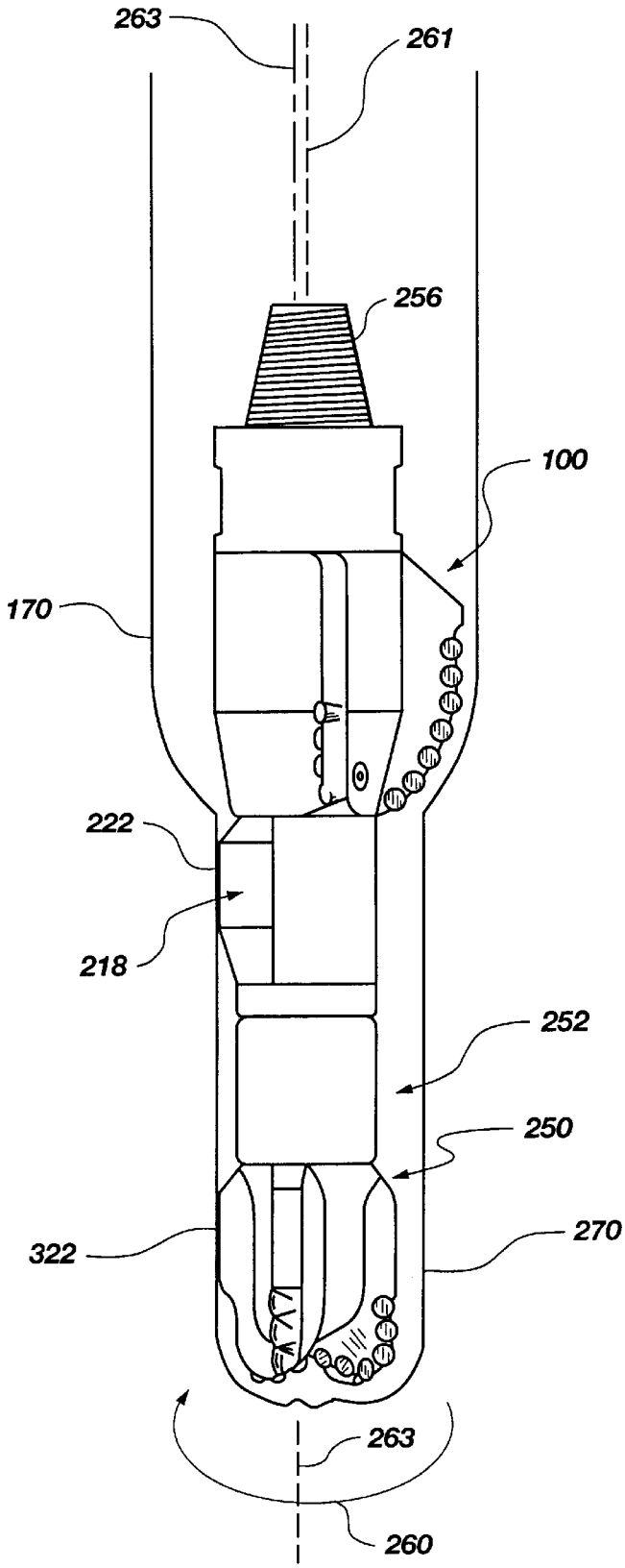
FIG. 3 depicts another embodiment of a reaming assembly according to the present invention disposed in a borehole.

FIG. 3 illustrates a side cross-sectional elevation of a PSP 218, short pilot sub 252, and pilot drill bit 250 configured as an offset assembly. Therefore, the centroidal rotational axis 263 of the offset assembly, the offset assembly comprising elements with aligned rotational axes, is offset from but parallel to the reaming axis 261. In this configuration, the gage of pilot drill bit 250 may contact the pilot borehole 270 to provide added stability to the reaming apparatus. The pilot drill bit 250 may be configured with a contact gage pad 322 designed to provide stability to the reamer wing 100. For instance, the contact gage pad 322 may be geometrically shaped similarly to the bearing surface 222 of PSP 218. Further, any desired design aspects of the PSP 218 may be incorporated into the contact gage pad 322 of the pilot drill bit 250.

Pilot drill bit 250 is depicted as a fixed PDC (polycrystalline diamond compact) cutter drill bit in FIGS. 1–3; however, the present invention contemplates other types of drill bits as comprising the pilot drill bit as well. Roller cone-type drill bits, coring-type drill bits, natural diamond drill bits or other earth-boring drill bits as known in the art may be employed as the pilot drill bit 250 depicted in FIGS. 1–3, as desired.

In the FIG. 3 embodiment, the pilot drill bit 250 operation is fundamentally different than typical pilot drill bit operation. Typically, the pilot drill bit 250 is drilled about its centroidal rotational axis, but may undesirably deviate therefrom, causing an oversized borehole. However, in this embodiment, the pilot drill bit 250 is intentionally caused or permitted to rotate about an axis other than its centroidal rotational axis because it is offset from reaming axis 261. In this embodiment, pilot drill bit 250 also defines an increased rotational diameter relative to its actual physical diameter. Therefore, pilot drill bit 250 creates an oversized borehole of prescribed size or diameter, in contrast to the uncontrolled oversized borehole shown in FIG. 1 or FIG. 2. Therefore, in FIG. 3, the PSP 218 is offset in relation to the prescribed oversized borehole and substantially continuously contacts the pilot borehole 270.

As illustrated in FIGS. 2 and 3, individual elements or components or structural features of a pilot hole assembly may be laterally offset from the reaming axis 261 of the reamer wing 100 to provide stabilization for the reamer wing 100. Alternatively, more than one element of the reaming assembly may be offset from the reaming axis 261 of the reamer wing 100. Upon offsetting one element of the pilot hole assembly, each element attached to the offset element may become offset as well. Elements of the pilot hole assembly may be placed at opposing offsets, additive offsets, or no mutual offset. Thus, aligning or intentionally misaligning a elements of the pilot hole assembly with respect to the reaming axis 261 may be accomplished by any combination of the aforementioned offsets.

FIG. 4 illustrates a top cross-sectional view of a reaming assembly of the present invention. Reaming borehole 170 and pilot borehole 270 are shown in relation to the reaming borehole center point 120. Circumferentially spaced primary reaming blades 110 and 112 remove formation material between the diameter of the pilot borehole 270 and that of the reamed borehole 170. Secondary blades 114 and 116 stabilize the reamer as it bearings from the pass-through (or physical) diameter to the reaming diameter of reamed borehole 170. In addition, secondary blades 114 and 116 serve to share cutting forces and remove reamed borehole material over their respective radial extents. Bore 104 in tubular body 102 serves to deliver and communicate drilling fluid to the pilot bit fluid ports or nozzles (not shown) as well as fluid ports or nozzles (not shown) carried by the reamer wing 100, such technology being well known in the art.

Cutting elements 122 are distributed along each of the primary blades 110 and 112 of the reamer wing 100 as well as the secondary blades 114 and 116. Cutting elements 122 may comprise polycrystalline diamond compacts (PDCs) or other superabrasive cutters.

PSP 218 is shown in a circumferential position somewhat aligned to secondary blade 116; however, PSP 218 may be circumferentially or rotationally aligned in any position favorable to stabilize the reamer wing 100. Typically, the PSP 218 is placed to substantially coincide with a resultant lateral force vector generated by the blades 110–116 of the reamer wing 100 during drilling. In some instances, such as if the reaming assembly is equipped with a steerable bottomhole assembly, the PSP 218 may be omitted. PSP 218 is also shown in FIG. 4 to be in substantially continuous contact with the wall of pilot borehole 270 in accordance with the present invention.

Angular position of contact gage pad 322 of pilot drill bit 250 is shown in FIG. 4 as being generally circumferentially or rotationally aligned with the PSP 218. Contact gage pad 322 is shown to be in substantially continuous contact with the wall of pilot borehole 270 by way of the embodiment shown in FIG. 3. However, if configured as in the embodiment of FIG. 2, wherein only the PSP 218 is offset, the contact gage pad 322, if employed with pilot drill bit 250, may not be in substantially continuous contact with the pilot borehole 270.

Figure 5:
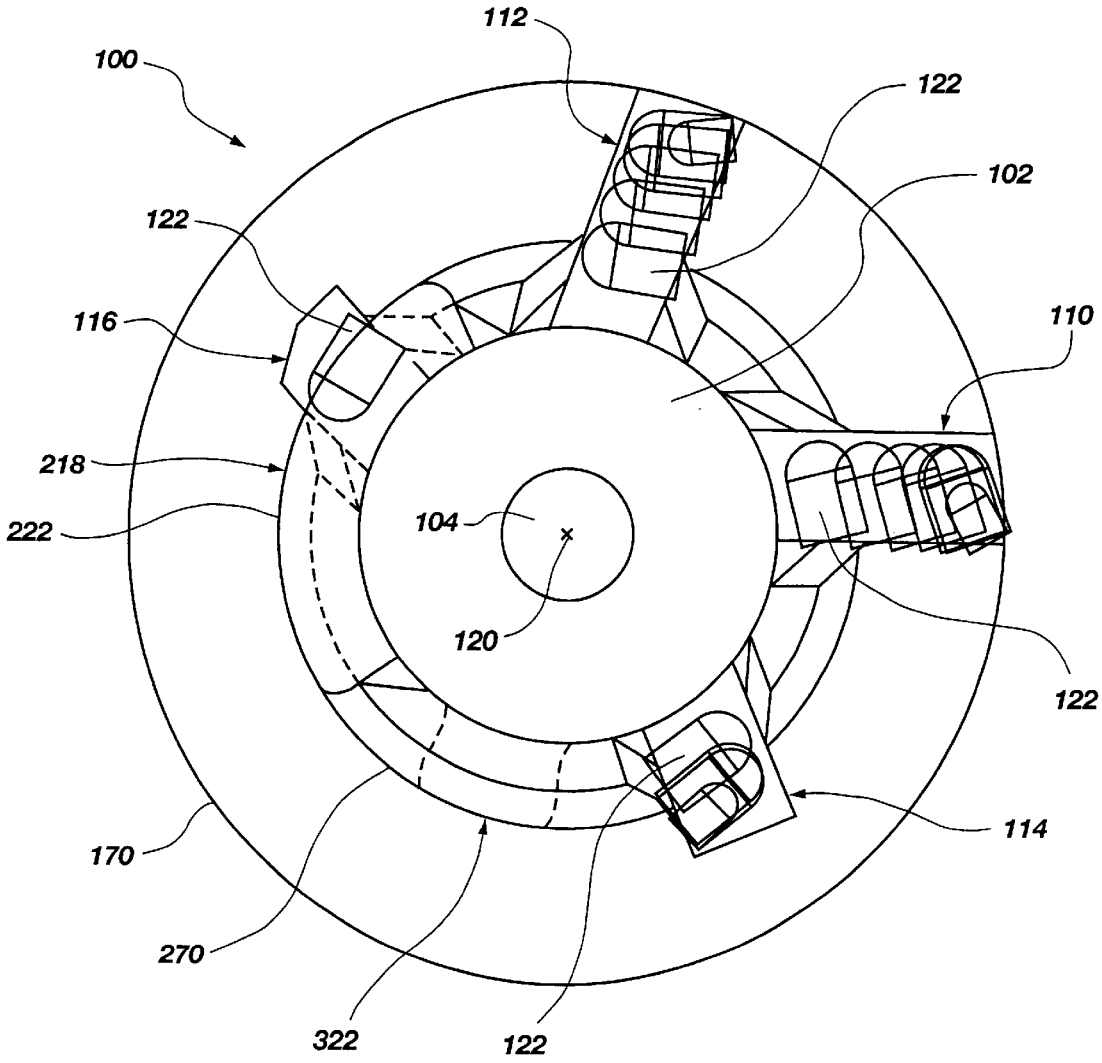
FIG. 5 depicts a cross-sectional view of a reaming assembly according to the present invention with a pilot stabilization pad and contact gage pad of a pilot drill bit substantially circumferentially offset.

FIG. 5 illustrates a top cross-sectional view of a reaming assembly of the present invention similar to FIG. 4. However, the angular position of contact gage pad 322 is not circumferentially aligned to the PSP 218. Such an embodiment may provide additional stability to the reamer wing 100 by providing another contact surface to the wall of pilot borehole 270 in addition to the PSP 218 contact surface. FIG. 5 shows the contact gage pad 322 in substantial continuous contact with the pilot borehole 270, as in FIG. 3.

Alternatively, if the embodiment of FIG. 5 is employed in an assembly configured as in FIG. 2, the contact gage pad 322 may not be in substantially continuous contact with the wall of pilot borehole 270. An embodiment of the design shown in FIG. 5 may be desired to foster compatibility between the reamer wing 100, short pilot sub 252, and pilot drill bit 250, since circumferential or rotational alignment of a contact gage pad 322 with PSP 218 via threaded connections requires careful design and may prevent easy interchangeability between various combinations of PSPs, drill bits, and reamer wings.

Figure 7:
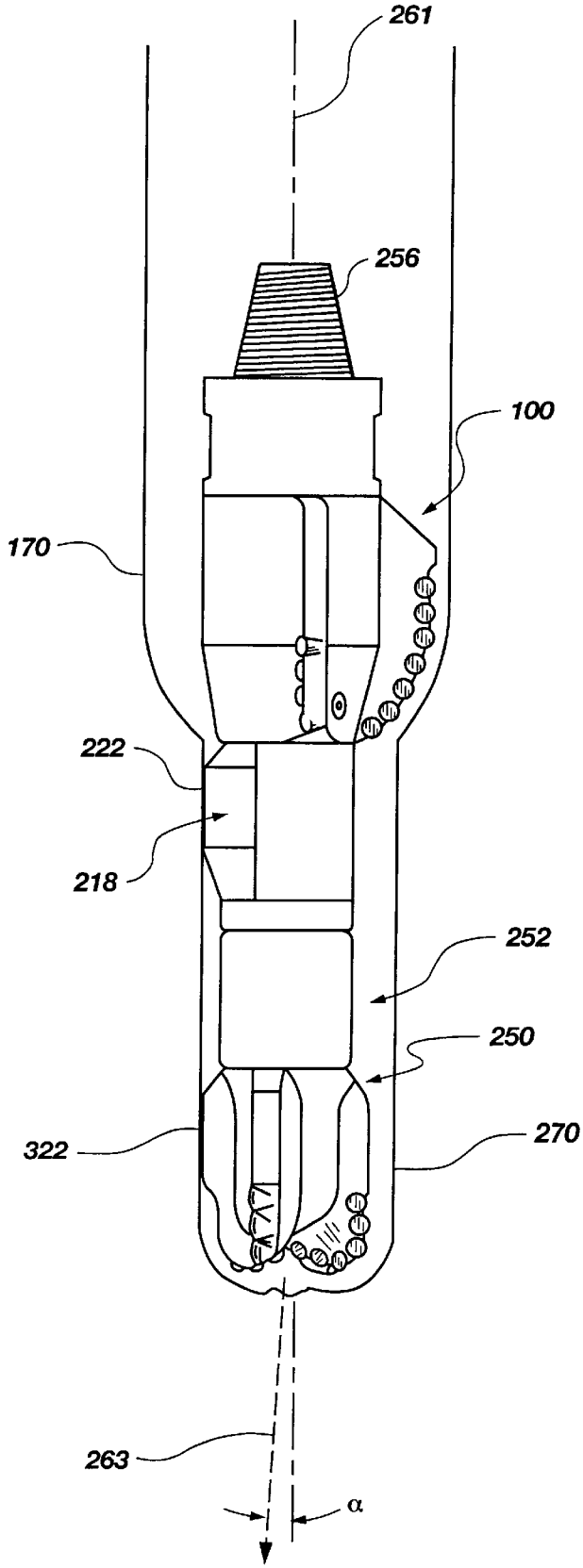
FIG. 7 depicts yet another embodiment of a reaming assembly according to the present invention disposed in a borehole.

FIG. 7 shows a side cross-sectional elevation of another reaming assembly of the present invention. The centroidal rotational axis 263 of the assembly comprising the PSP 218, short pilot sub 252, and pilot drill bit 250 is angularly offset by angle $\alpha$ (shown greatly exaggerated) with respect to the reaming axis 261. As the reaming tool rotates about the reaming axis 261, the PSP 218 and pilot drill bit 250 (as well as assembly centroidal rotational axis 263) rotates about reaming axis 261. The circumferential bearing surface 222 of the PSP 218 and the surface of contact gage pad 322 may be oriented or longitudinally tapered so as to substantially conformally contact the wall of pilot borehole 270. Specifically, the circumferential bearing surface 222 of the PSP 218 and the surface of contact gage pad 322 may be angularly tapered with respect to the centroidal rotational axis 263 such that when rotated about the reaming axis 261, the surfaces are oriented substantially parallel to the wall of pilot borehole 270.

Again, although the pilot drill bit 250 has been illustrated as a fixed cutter bit, pilot drill bit 250 may comprise a roller cone bit or other bit known in the art. In addition, modifications to pilot drill bit 250 proposed or described herein may be rendered on different drill bit types to achieve similar results. For instance, in the case of a roller cone bit, the gage area as well as the heel row teeth may be modified to continuously engage the pilot borehole 270 in the embodiment shown in FIG. 3, among others. Diamond-enhanced compacts, hardfacing, or other modifications to provide bearing surfaces may be made to the roller cone bit, as known in the art.

Other configurations comprising combinations of offsets are encompassed by the present invention. For instance, the PSP 218 may be offset laterally in displacement, while the drill bit is angularly offset. Any combination of lateral offsets and angular offsets may be employed separately or in combination to any reaming apparatus to gain the advantages of the present invention. Thus, lateral offsets of, for example, a pilot bit and a PSP may be employed together, angular offsets thereof employed together, an angular offset of one employed with a lateral offset of the other, or one component may be both angularly and laterally offset while another associated component is not.

Although the foregoing description contains many specifics, these should not be construed as limiting the scope of the present invention, but merely as providing illustrations of some exemplary embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions, and modifications to the invention, as disclosed herein, which fall within the meaning and scope of the claims are to be embraced thereby.

What is claimed is:

1. A reaming apparatus for drilling and expanding a borehole in a subterranean formation to a larger diameter, comprising:

a longitudinally extending body having at least one blade extending radially outwardly therefrom, the at least one blade including at least one cutter thereon, the longitudinally extending body rotatable about a reaming axis for cutting a selected reaming diameter; and a pilot assembly comprising:

a pilot drill bit for drilling a pilot borehole of a diameter smaller than the selected reaming diameter; and at least one pilot stabilization pad disposed longitudinally between the longitudinally extending body and the pilot drill bit defining a rotational diameter;

wherein the rotational diameter of the at least one pilot stabilization pad about the reaming axis is larger than a physical diameter of the pilot drill bit.

2. The reaming apparatus of claim 1, wherein the pilot drill bit defines a rotational diameter about the reaming axis for cutting the selected reaming diameter that is larger than the pilot drill bit physical diameter.

3. The reaming apparatus of claim 1, wherein the pilot drill bit is adapted to drill a pilot borehole of a greater diameter than the physical diameter of the pilot drill bit and substantially the same as or smaller than the pilot stabilization pad rotational diameter.

4. The reaming apparatus of claim 1, wherein the at least one pilot stabilization pad is configured to substantially conformally contact a wall of the pilot borehole.

5. The reaming apparatus of claim 1, wherein the at least one pilot stabilization pad includes at least a longitudinally tapered leading portion.

6. The reaming apparatus of claim 1, wherein the pilot drill bit and the at least one pilot stabilization pad are positioned and configured so that a rotational diameter of the pilot drill bit and the rotational diameter of the at least one pilot stabilization pad are substantially the same.

7. The reaming apparatus of claim 1, wherein the larger rotational diameter of the at least one pilot stabilization pad is effected due to an offset of a rotational axis of the at least one pilot stabilization pad with respect to a rotational axis of the pilot drill bit.

8. The reaming apparatus of claim 1, wherein the at least one pilot stabilization pad exhibits a rotational axis coincident with a rotational axis of the pilot drill bit and the larger rotational diameter of the at least one pilot stabilization pad is effected by the at least one pilot stabilization pad extending from the coincident axes farther than the physical diameter of the pilot drill bit.

9. A reaming apparatus for drilling and enlarging a borehole in a subterranean formation, comprising:

a longitudinally extending body having at least one blade extending radially outwardly therefrom, the at least one blade including at least one cutter thereon, the longitudinally extending body rotatable about a reaming axis for cutting a selected reaming diameter; and a pilot assembly comprising:

a pilot drill bit having a centroidal rotational axis for drilling a pilot borehole of a diameter smaller than the selected reaming diameter; and at least one pilot stabilization pad disposed longitudinally between the longitudinally extending body and the pilot drill bit;

wherein the pilot drill bit centroidal rotational axis is offset with respect to the reaming axis.

10. The reaming apparatus of claim 9, wherein the pilot drill bit centroidal rotational axis is parallel to the reaming axis.

11. The reaming apparatus of claim 9, wherein the pilot drill bit centroidal rotational axis and the reaming axis are nonparallel.

12. The reaming apparatus of claim 9, wherein the at least one pilot stabilization pad is configured to substantially conformally contact a wall of the pilot borehole.

13. The reaming apparatus of claim 9, wherein the at least one pilot stabilization pad includes at least a longitudinally tapered leading portion.

14. The reaming apparatus of claim 9, wherein the pilot drill bit includes at least one gage area.

15. The reaming apparatus of claim 14, wherein the at least one gage area is configured to substantially continuously contact a wall of the pilot borehole.

16. The reaming apparatus of claim 14, wherein the at least one gage area is configured to substantially conformally contact a wall of the pilot borehole.

17. The reaming apparatus of claim 14, wherein the at least one gage area is longitudinally tapered.

18. The reaming apparatus of claim 14, wherein the at least one gage area is configured to stabilize the reaming apparatus by substantially continuous contact with a wall of the pilot borehole.

19. The reaming apparatus of claim 14, wherein the at least one gage area is substantially circumferentially aligned with the at least one pilot stabilization pad.

20. The reaming apparatus of claim 14, wherein the at least one gage area is substantially circumferentially aligned with a predicted force vector to be generated by contact of the at least one cutter on the at least one blade with the subterranean formation.

21. The reaming apparatus of claim 9, wherein the pilot drill bit is adapted to drill a pilot borehole of a diameter greater than a physical diameter of the pilot drill bit about the reaming axis for cutting the selected reaming diameter and wherein the pilot drill bit and the at least one pilot stabilization pad are positioned and configured so that a rotational diameter of the pilot drill bit and a rotational diameter of the at least one pilot stabilization pad are substantially the same.

22. The reaming apparatus of claim 9, wherein the pilot drill bit is adapted to drill a pilot borehole of a diameter greater than a physical diameter of the pilot drill bit about the reaming axis for cutting the selected reaming diameter.

23. A reaming apparatus for drilling and enlarging a borehole in a subterranean formation to a larger diameter, comprising:

a longitudinally extending body having at least one blade extending radially outwardly therefrom, the at least one blade including at least one cutter thereon, the longitudinally extending body rotatable about a reaming axis for cutting a selected reaming diameter; and a pilot assembly comprising:

a pilot drill bit having a centroidal rotational axis for drilling a pilot borehole of a diameter smaller than the selected reaming diameter; and at least one pilot stabilization pad having a centroidal rotational axis and disposed longitudinally between the longitudinally extending body and the pilot drill bit;

wherein the pilot stabilization pad centroidal rotational axis is offset with respect to the reaming axis.

24. The reaming apparatus of claim 23, wherein the pilot stabilization pad centroidal rotational axis is parallel to the reaming axis.

25. The reaming apparatus of claim 23, wherein the pilot stabilization pad centroidal rotational axis and the reaming axis are nonparallel.

26. The reaming apparatus of claim 23, wherein the at least one pilot stabilization pad is configured to substantially conformally contact a wall of the pilot borehole.

27. The reaming apparatus of claim 23, wherein the at least one pilot stabilization pad includes at least a longitudinally tapered leading portion.

28. The reaming apparatus of claim 23, wherein the pilot drill bit includes at least one gage area.

29. The reaming apparatus of claim 28, wherein the at least one gage area is configured to substantially continuously contact a wall of the pilot borehole.

30. The reaming apparatus of claim 28, wherein the at least one gage area is configured to substantially conformally contact a wall of the pilot borehole.

31. The reaming apparatus of claim 28, wherein the at least one gage area is longitudinally tapered.

32. The reaming apparatus of claim 28, wherein the at least one gage area is configured to stabilize the reaming apparatus by substantially continuous contact with a wall of the pilot borehole.

33. The reaming apparatus of claim 28, wherein the at least one gage area is substantially circumferentially aligned with the at least one pilot stabilization pad.

34. The reaming apparatus of claim 28, wherein the at least one gage area is substantially circumferentially aligned with a predicted force vector to be generated by contact of the at least one cutter on the at least one blade.

35. The reaming apparatus of claim 23, wherein the pilot drill bit is adapted to drill a pilot borehole of a diameter greater than a physical diameter of the pilot drill bit about the reaming axis for cutting the selected reaming diameter and wherein the pilot drill bit and the at least one pilot stabilization pad are positioned and configured so that a rotational diameter of the pilot drill bit and a rotational diameter of the at least one pilot stabilization pad are substantially the same.

36. The reaming apparatus of claim 23, wherein the pilot drill bit is adapted to drill a pilot borehole of a diameter greater than a physical diameter of the pilot drill bit about the reaming axis for cutting the selected reaming diameter.

37. A reaming apparatus for drilling and expanding a borehole in a subterranean formation to a larger diameter, comprising:

a longitudinally extending body having at least one blade extending radially outwardly therefrom, the at least one blade including at least one cutter thereon, the longitudinally extending body rotatable about a reaming axis for cutting a reaming diameter; and a pilot assembly comprising:

a pilot drill bit for drilling a pilot borehole of a diameter smaller than the reaming diameter; and at least one pilot stabilization pad;

wherein at least one component of the pilot assembly has a centroidal rotational axis offset with respect to the reaming axis.

38. A method of forming an oversized pilot borehole by way of a reaming apparatus, comprising:

providing a reaming tool rotatable about a reaming axis for enlarging a pilot borehole and a pilot bit apparatus attached thereto including a pilot bit for drilling the pilot borehole and a pilot stabilization pad defining a rotational diameter substantially the same as a rotational diameter of the pilot bit but larger than a physical diameter of the pilot bit;

applying a longitudinal force to the reaming tool and pilot bit apparatus; and simultaneously rotating the reaming tool and the pilot bit apparatus.

* * * * *

UNITED STATES PATENT AND TRADEMARK OFFICE

CERTIFICATE OF CORRECTION

PATENT NO. : 6,739,416 B2
DATED : May 25, 2004
INVENTOR(S) : W. Gregory Presley et al.

It is certified that error appears in the above-identified patent and that said Letters Patent is hereby corrected as shown below:

Column 2,
Line 52, delete “Be”
Line 67, change “incorporate” to -- incorporated --

Column 7,
Line 36, before “elements” delete “a”

Signed and Sealed this

Eighteenth Day of January, 2005

JON W. DUDAS
*Director of the United States Patent and Trademark Office*